US006679792B1

(12) United States Patent
Dorfman

(10) Patent No.: US 6,679,792 B1
(45) Date of Patent: Jan. 20, 2004

(54) GOLF TEE WITH ENCAPSULATED SHEET SUBSTRATE

(76) Inventor: Robert S. Dorfman, 5601 NW. 2nd Ave., Suite 120, Boca Raton, FL (US) 33487-3849

( * ) Notice: Subject to any disclaimer, the term of this patent is extended or adjusted under 35 U.S.C. 154(b) by 0 days.

(21) Appl. No.: 10/346,265

(22) Filed: Jan. 15, 2003

(51) Int. Cl.[7] ..... A63B 57/00
(52) U.S. Cl. ..... 473/387; 473/399; 473/390
(58) Field of Search ..... 473/387–403, 473/594; 283/56

(56) References Cited

U.S. PATENT DOCUMENTS 5,016,918 A * 5/1991 Tidwell ..... 473/387
5,571,054 A * 11/1996 Chantal ..... 473/387
5,672,089 A * 9/1997 Piera Bermejo ..... 473/594

OTHER PUBLICATIONS

Golf Digest "Tees–20 Colors" Jul. 1971, p. 87.*

* cited by examiner

*Primary Examiner*—Steven Wong
(74) *Attorney, Agent, or Firm*—Robert M. Downey, PA

(57) ABSTRACT

A golf tee includes first and second symmetrical halves extending from a distal tip to an enlarged head and a sheet substrate sandwiched between the tee halves. The first and second tee halves are formed of a transparent material so that indicia, such as an advertisement or promotional message, printed on one or both opposite faces of the sheet substrate is visibly exposed along the stem of the formed tee. The two tee halves are joined together through several openings in the sheet substrate, thereby enhancing the bonding between the tee halves to form an integral unit. Use of a biodegradable material composition in the manufacture of the tee halves and sheet substrate, along with the divided structure of the first and second tee halves, enhances disintegration of the golf tee in the natural environment.

20 Claims, 2 Drawing Sheets

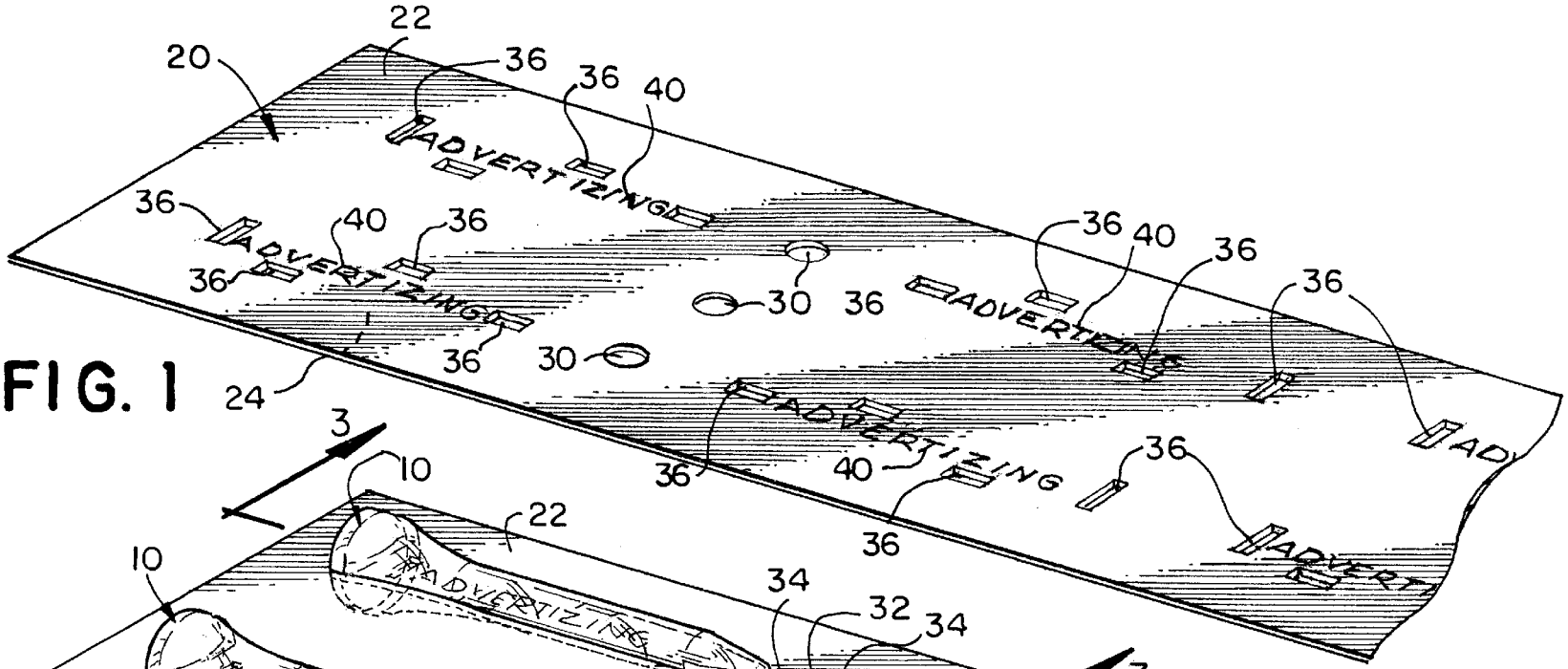
ADVERTISING
ADVERTISING
ADVERTISING

FIG. 3
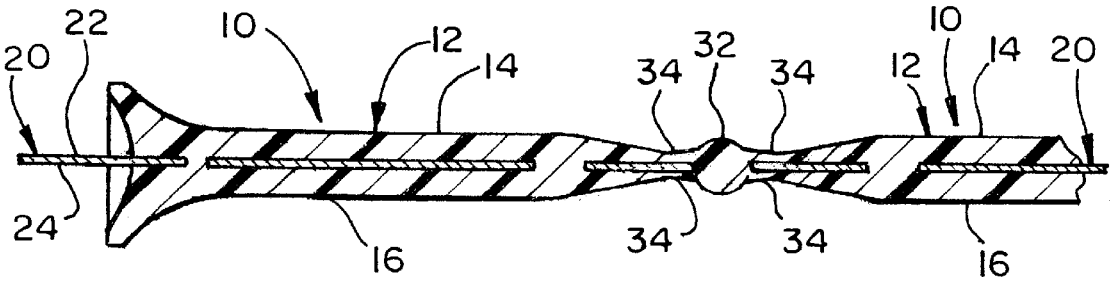
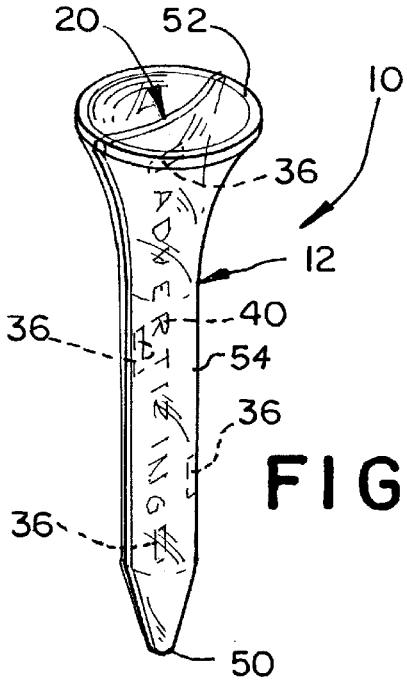
FIG. 4

GOLF TEE WITH ENCAPSULATED SHEET SUBSTRATE

BACKGROUND OF THE INVENTION

1. Field of the Invention

The present invention is directed to a golf tee having a sheet substrate sandwiched between two halves and a method of manufacturing the same, and, more particularly, to a biodegradable golf tee comprising two transparent symmetrical tee halves sandwiching a sheet substrate having an advertisement or other indicia printed on one or both sides thereof, and wherein the printed advertisement or other indicia is visible through the transparent molded body of the tee.

2. Discussion of the Related Art

Golf tees are typically manufactured from natural wood or any of a variety of plastic compositions. In the past, plastic golf tees were popular due to the ability to economically mass produce tees of consistent size and shape, without imperfections, using inexpensive material. However, the inability of plastic golf tees to disintegrate when discarded on the golf course has become a serious environmental concern. In fact, many golf courses now ban the use of tees formed of non-biodegradable material. For this reason, most golf tees sold in today's market are formed of natural wood.

Over time, it has been discovered that golf tees provide a convenient medium for displaying an advertisement or other message promoting a business or product. The shank or stem portion of the golf tee, extending between the pointed distal tip and the head, is particularly ideal for displaying a trademark, slogan, business name and telephone number, Internet website address, or other message. Application of such indicia to the now predominantly used wood tees requires each wood tee to be individually hot stamped. This process of applying indicia to wood golf tees is performed as an independent process after the wood golf tees have been manufactured, and often by a company other than the tee manufacturer. This less than efficient process of individually hot stamping wood tees to apply advertisements or other promotional messages increases the overall cost per unit of the finished product.

In view of the foregoing problems associated with both plastic, non-biodegradable golf tees and wood tees, there remains an urgent need in the golf industry for a biodegradable golf tee which can be mass produced in an efficient injection molding process. Moreover, there remains a definite need in the golf industry for a biodegradable golf tee which has an advertisement or other indicia applied during a manufacturing process, thereby providing a disposable and environmentally friendly promotional product which is cost effective to manufacture.

SUMMARY OF THE INVENTION

The present invention is directed to a biodegradable golf tee which includes an advertisement, promotional message or other indicia displayed along the shank of the golf tee, between the distal tip and the head. The golf tee is manufactured in accordance with a unique injection molding process and includes a pair of symmetrical halves extending from the distal tip to the enlarged head, and a sheet substrate sandwiched between the tee halves. During the manufacturing process, the sheet substrate serves as a carrier or pallet to facilitate both the injection molding of the symmetrical tee halves on opposite sides of the sheet substrate and ejection of the sheet pallet and molded components from the mold. The sheet substrate, sandwiched between the tee halves, also provides an adhesion means between the sandwiched assembly, holding the opposing symmetrical tee halves on opposite sides of the thin sheet substrate to form an integral unit. To increase the bonding between each of the tee halves, a plurality of keys (i.e. rectangular openings) are pre-punched through the sheet substrate. This allows the molten plastic to pass through and fill within the rectangular holes during the injection molding process, thereby joining the two molded halves of the tee together as a integral one-piece unit.

Prior to molding, an advertisement, promotional message or other indicia is printed on one or both opposite faces of the sheet pallet. The printed copy is duplicated in accordance with a predetermined spaced arrangement to allow for multiple tee units to be molded on a single sheet. The pallet is then inserted between the mold components prior to the injection mold process so that the areas of the pallet bearing the printed advertisements are encapsulated between the respective opposing mold cavities for each tee unit. After molding, the pallet and attached molded tee halves drop from the injection mold, whereupon the entire pallet, with the molded tee halves on each side, is die cut and separated into individual golf tee units. The manufactured golf tee unit comprises the two symmetrical tee halves with the sheet substrate sandwiched therebetween, so that the advertising copy printed on the sheet substrate is visible through the clear plastic biodegradable material of the tee halves.

OBJECTS AND ADVANTAGES OF THE INVENTION

With the foregoing in mind, it is a principal object of the present invention to provide a biodegradable golf tee which contains an advertisement, promotional message or other indicia.

It is a further object of the present invention to provide a biodegradable golf tee having an encapsulated sheet substrate for displaying an advertisement, promotional message or other indicia.

It is still a further object of the present invention to provide a golf tee including a sheet substrate encapsulated within a clear biodegradable molded plastic material, and wherein the sheet substrate includes an advertisement, message or other indicia printed thereon which is visible through the clear material of the molded tee.

It is still a further object of the present invention to provide a golf tee formed of a clear biodegradable molded plastic material, and wherein the golf tee can be manufactured via a highly efficient injection molding process.

It is still a further object of the present invention to provide a golf tee formed through an injection mold process and including two symmetrical halves formed of a clear material and sandwiching a sheet substrate so that an advertisement, message, or other indicia printed on one or both sides of the sheet substrate is visible through the clear material of the molded tee.

It is yet a further object of the present invention to provide an improved and highly efficient method of manufacturing a golf tee, wherein a sheet substrate serves as a pallet to facilitate the molding and ejection of the assembled tee components from the mold, and wherein the sheet substrate serves as a means for bonding the two molded symmetrical halves of the tee as an integral unit.

It is still a further object of the present invention to provide an improved method of manufacturing a golf tee, wherein an advertisement, promotional message or other indicia is efficiently and cost effectively printed on one or both of opposite sides of a sheet substrate, and further wherein the sheet substrate serves as a pallet to facilitate the molding of opposite, symmetrical halves of a tee to sandwich the sheet substrate therebetween, and wherein the printed advertisement, promotional message or other indicia is visible through the clear molded plastic tee halves.

It is still a further object of the present invention to provide an improved process for molding a golf tee which includes an advertisement, promotional message or other indicia, and wherein the process includes placing a sheet substrate between the opposing cavities of a multiple cavity mold to thereby facilitate molding of a plurality of tee units on opposite sides of a single sheet substrate, and wherein the individual tee units are separated from the sheet substrate by die cutting after the molding process.

It is still a further object of the present invention to provide a biodegradable golf tee which is suitable for advertising purposes and which is more cost effective and efficient to manufacture as compared to hot stamping conventional wood golf tees.

It is still a further object of the present invention to provide a improved and more cost efficient process for manufacturing a biodegradable golf tee which includes an advertisement, promotional message or other indicia.

These and other objects of the present invention will be more readily apparent with reference to the detailed description and the accompanying drawings.

BRIEF DESCRIPTION OF THE DRAWINGS

For a fuller understanding of the nature of the present invention, reference should be made to the following detailed description taken in conjunction with the accompanying drawings in which:

FIG. 1 is a top perspective view, in partial cutaway, illustrating a sheet substrate used in accordance with the product and process of the present invention, and wherein the sheet substrate includes an arrangement of printed advertisements or messages on one or both sides thereof for encapsulation within the transparent molded tee product of the present invention;

FIG. 2 is a top perspective view, in partial cutaway, showing a plurality of golf tees molded on opposite sides of the sheet substrate of FIG. 1 in accordance with a molding process of the present invention;

FIG. 3 is a cross-sectional view taken along the plane of the line indicated as 3—3 in FIG. 2; and FIG. 4 is a perspective view of the golf tee of the present invention, molded in accordance with the process of the present invention, wherein the molded golf tee includes symmetrical molded halves and the sheet substrate sandwiched between the tee halves so that the advertising message printed on the sheet substrate is visible through the transparent material of the tee halves.

Like reference numerals refer to like parts throughout the several views of the drawings.

DETAILED DESCRIPTION OF THE PREFERRED EMBODIMENT

Referring to the several views of the drawings, and initially FIGS. 3 and 4, the golf tee of the present invention is shown and generally indicated as 10. The golf tee 10 is formed in an injection molding process, as described more fully hereinafter, and includes a main body 12 formed of a transparent plastic composition. In a preferred embodiment, the transparent plastic composition is a biodegradable material.

The molded body 12 includes a first molded half 14 and a second molded half 16. As seen in FIG. 3, the molded halves 14 and 16 are generally symmetrical and are formed on opposite sides of a sheet substrate 20.

Referring to FIGS. 1–3, the sheet substrate 20 includes a top face 22 and an opposite bottom face 24. The sheet substrate may be selected from any of a variety of materials suitable for the manufacturing process and objectives of the present invention. In one embodiment, the sheet substrate 20 is a paper material which is preferably impregnated or treated with an agent to enhance or accelerate deterioration when left in a natural environment. In another embodiment, the sheet substrate 20 is a plastic film which may be transparent. In a further embodiment, the plastic film defining the sheet substrate 20 is a biodegradable plastic composition.

In the process for manufacturing the golf tee 10, the sheet substrate 20 serves as both a medium for applying an advertisement, promotional message or other indicia thereon, as well as a carrier or pallet to facilitate the molding and ejection of the assembled tee halves 14, 16 from the mold. The sheet substrate 20 also provides an adhesion means between the first and second halves 14,16 of the molded tee.

Referring to FIG. 1, the sheet substrate 20 is first prepared by forming circular holes 30 and key openings 36 through the substrate. Advertising copy or other indicia 40 is applied to either or both of the opposite top and bottom faces 22, 24 of the sheet substrate 20 in accordance with a predetermined arrangement. The advertising copy 40 may be applied to the sheet substrate before or after the forming of the holes 30 and openings 36, which is accomplished by punching the sheet substrate in an automated process. The key openings 36 and advertisement copy or other indicia 40 are specifically arranged within areas on the sheet substrate which will eventually be encapsulated within the opposing tee halves 14, 16. In the molding process, the sheet substrate 20 is inserted between opposing halves of the mold which close onto the opposite faces 22, 24 of the sheet substrate so that the areas containing the rectangular openings 36 and advertising copy 40 are positioned within respective cavities of the mold.

Referring to FIG. 2, a runner system is provided in the mold for feeding plastic molten material to each tee cavity. The sheet substrate, and more particularly the area containing the rectangular openings 36 and advertising copy 40, is sandwiched between the opposing halves of each tee cavity. In the runner system, a primary molded sphere 31 is positioned within one of the circular openings 30 punched through the sheet substrate and provides a main injection reservoir. Runners 33 extend from the main injection reservoir 31 outwardly to secondary molded spheres 32 positioned within circular openings 30 punched through the sheet substrate 20. The secondary molded spheres 32 provide wells for distributing molten plastic material to the mold cavities during the injection mold process. Gates 34 on the top and bottom faces of the sheet substrate 20 extend from each of the respective wells 32 and the communicating mold cavities. Accordingly, the molten plastic material flows from the wells 32 and through the gates 34, on the opposite faces of the sheet substrate, and into the respective cavity pairs on the opposite sides of the sheet substrate. The splitting of flow of the molten material, under pressure, through the gates 34 on opposite sides of the sheet substrate is necessary to provide equal hydraulic pressure on each side of the sheet substrate, thereby preventing the sheet substrate from bursting as a result of a higher hydraulic pressure applied to one side of the sheet substrate. As the molten plastic material fills the opposing cavity pairs on the opposite faces of the sheet substrate, the molten plastic naturally flows through the key openings 36 communicating between the opposing cavity pairs. This causes the molten plastic to fill within the key openings 36 thereby joining the first molded half 14 to the second molded half 16, as best seen in FIG. 3. The joining of the first and second halves 14, 16 through the key openings 36 increases the bonding between the tee halves 14, 16, and yet allows the tee halves to remain divided, on opposing sides of the sheet substrate. This divided structure of the tee halves enhances the rate of disintegration of the golf tee when discarded in the natural environment.

Once the molten plastic material has been injected within the mold cavities and allowed to cool and cure, the sheet substrate and attached molded tee halves drop from the injection mold. At this stage, the entire sheet substrate, serving as a pallet, is die cut around the periphery of the molded tee halves to separate the molded tee halves from the remainder of the sheet substrate 20.

The manufactured golf tee product 10, produced in the manufacturing process described above, is shown in FIG. 4. The molded body 12 of the golf tee 10 comprises the first and second molded halves 14, 16 extending from a pointed distal end 50 to an enlarged head 52. The head 52 is formed and configured in a conventional manner to include a concave dish for supporting a golf ball thereon when the pointed distal tip 50 is inserted into the ground. The sheet substrate 20 is sandwiched between the opposing tee halves 14, 16 so that the advertising copy or other indicia. 40 is clearly visible through the transparent material of the golf tee body 12. As seen in FIG. 4, the advertising copy 40 is visibly disposed along the shank or stem 54 of the tee body, between the pointed distal tip 50 and the head 52. As mentioned above, the advertising copy or other indicia 40 may appear on one or both of the opposite faces of the sheet substrate so that one or more advertisements or other messages may be displayed on both of the opposite tee halves.

While the instant invention has been shown and described in accordance with a preferred and practical embodiment thereof, it is recognized that departures from the instant disclosure are contemplated within the spirit and scope of the present invention which, therefore, should not be limited except as set forth in the following claims as interpreted under the doctrine of equivalents.

What is claimed is:

1. A golf tee comprising:

a main body formed of a transparent biodegradable material and including a distal tip, a head for supporting a golf ball thereon, and a shank extending between said distal tip and said head;

a sheet substrate longitudinally disposed within said main body between said head and said distal tip, and said sheet substrate including a first main face and an opposite second main face; and at least one of said first and second main faces including indicia thereon, and wherein said indicia is visible through said transparent biodegradable material of said main body.

2. The golf tee as recited in claim 1 wherein said indicia is visibly disposed along said shank.

3. The golf tee as recited in claim 2 wherein said indicia is on both said first main face and said second main face of said sheet substrate.

4. The golf tee as recited in claim 3 wherein said sheet substrate extends at least a portion of the longitudinal length of said shank.

5. The golf tee as recited in claim 3 wherein said sheet substrate extends through at least a portion of the length of said main body.

6. The golf tee as recited in claim 3 wherein said sheet substrate extends through the entire longitudinal length of said main body from said distal tip to said head.

7. The golf tee as recited in claim 2 wherein said main body includes a first half and a second half and wherein said first and second halves are symmetrical.

8. The golf tee as recited in claim 7 wherein said sheet substrate is sandwiched between said first half and said second half.

9. The golf tee as recited in claim 8 wherein said first half and said second half are joined together through at least one opening in said sheet substrate.

10. The golf tee as recited in claim 1 wherein said sheet substrate is formed of a biodegradable material.

11. The golf tee as recited in claim 1 wherein said sheet substrate is transparent.

12. The golf tee as recited in claim 1 wherein said sheet substrate is formed of a transparent biodegradable material.

13. The golf tee as recited in claim 1 wherein said sheet substrate is impregnated with an agent for accelerating a rate of natural disintegration.

14. A golf tee comprising:

a main body formed of a transparent material and including a distal tip, a head for supporting a golf ball thereon, and a shank extending between said distal tip and said head, and said main body further including a first half and a second half, said first and second halves extending from said distal tip to said head;

a sheet substrate sandwiched between said first half and said second half of said main body, and said sheet substrate including a first main face and an opposite second main face, said first and second main faces being encapsulated within said main body; and at least one of said first and second main faces including indicia thereon, and wherein said indicia is visible through said transparent material of said main body.

15. The golf tee as recited in claim 14 wherein said indicia is on both said first main face and said second main face of said sheet substrate.

16. The golf tee as recited in claim 14 wherein said first half and said second half are joined together through at least one opening in said sheet substrate.

17. The golf tee as recited in claim 14 wherein said transparent material of said main body is biodegradable.

18. The golf tee as recited in claim 17 wherein said sheet substrate is biodegradable.

19. A process for manufacturing a golf tee comprising the steps of:

applying indicia to an area on at least one side of a sheet substrate;

placing said sheet substrate in a mold so that said area of said sheet substrate having said applied indicia is positioned in sandwiched relation between opposing cavity portions of said mold upon closing said mold;

injecting a transparent material, in a molten state, into said opposing cavity portions of said mold to form a golf tee, wherein said area of said sheet substrate is sandwiched between a first molded half and a second molded half of said golf tee and said applied indicia is visible through said transparent material.

20. The process as recited in claim 19 further comprising the steps of:

forming at least one opening through said sheet substrate within said area; and allowing said transparent material to flow through and fill said at least one opening during said step of injecting, and thereby joining said first half and said second half of said molded golf tee through said at least one opening.

* * * * *